United States Patent [19]

Rivera

[11] 4,438,536

[45] Mar. 27, 1984

[54] HIGH PRESSURE TOILET WATER FEEDER CONVERSATION TANK

[76] Inventor: Alfredo Rivera, 1266 Olmstead Ave., Apt. 2-F, Bronx, N.Y. 10462

[21] Appl. No.: 330,029

[22] Filed: Dec. 11, 1981

[51] Int. Cl.[3] ..... E03D 1/02

[52] U.S. Cl. ..... 4/343; 4/366; 4/665; 4/415

[58] Field of Search ..... 4/343, 344, 353, 354, 4/359, 366, 415, 661, 665

[56] References Cited

U.S. PATENT DOCUMENTS 525,659 9/1894 King ..... 4/343

3,318,449 5/1967 Jennings et al. ..... 4/665 X

FOREIGN PATENT DOCUMENTS 2336744 2/1975 Fed. Rep. of Germany ..... 4/415

*Primary Examiner*—Henry K. Artis

*Attorney, Agent, or Firm*—Richard L. Miller

[57] ABSTRACT

A tank containing conserved water having a drainpipe connected to a fresh water supply pipe of a toilet, and a valve along the drainpipe being automatically operated by a high pressure valve located along the fresh water supply pipe.

1 Claim, 3 Drawing Figures

HIGH PRESSURE TOILET WATER FEEDER CONVERSATION TANK

This invention relates generally to toilet flushing systems. More specifically it relates to an automatic flushing valve of a water conservation tank used in conjunction with a fresh water supply to the toilet.

BACKGROUND OF THE INVENTION

Heretofore whenever a person wished to conserve the fresh water supply to a toilet, and use conserved water for flushing thereof, he has been obliged to manually place conserved water into the toilet tank, and which he has saved up from other previous uses such as from a bath, and the like. The applicant has shown in previous patent applications that such saved water may be stored in a conservation tank from where it can be entered into the toilet flushing system in substitution of the normal fresh water supply. Such conserved water may possibly be already quite dirty, particularly if it includes water that has been used in rinsing clothes, or bath, or shower, so that such water sitting in a toilet bowl, gives it a very unclean appearance. It is believed that if such soiled water were more diluted with a small portion of fresh water, then it would appear less objectionable when seen in a toilet bowl that is supposedly in a flush condition. Accordingly, heretofore a person using conserved water for flushing a toilet, does upon occasion use the fresh water supply instead, so that the toilet bowl is not continuously as dirty. However this is still not ideal, so that the situation is still in need of an improvement.

SUMMARY OF THE INVENTION

Therefore it is a principal object of the present invention, to provide a flushing valve for a water conservation tank, whereby some fresh water is flushed together with the conserved water so that the water left in the toilet bowl appears less soiled.

Another object is to provide a water conservation tank flushing valve which is automatically operated by the conventional high pressure valve of the fresh water supply system, so as to require no additional manual attention to flush both waters.

Yet another object is to provide a high pressure toilet water feeder conservation tank wherein the proportions of fresh and conserved waters is adjustable, as needed.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows.

DETAILED DESCRIPTION OF THE PREFERRED EMBODIMENT

Figure 1:
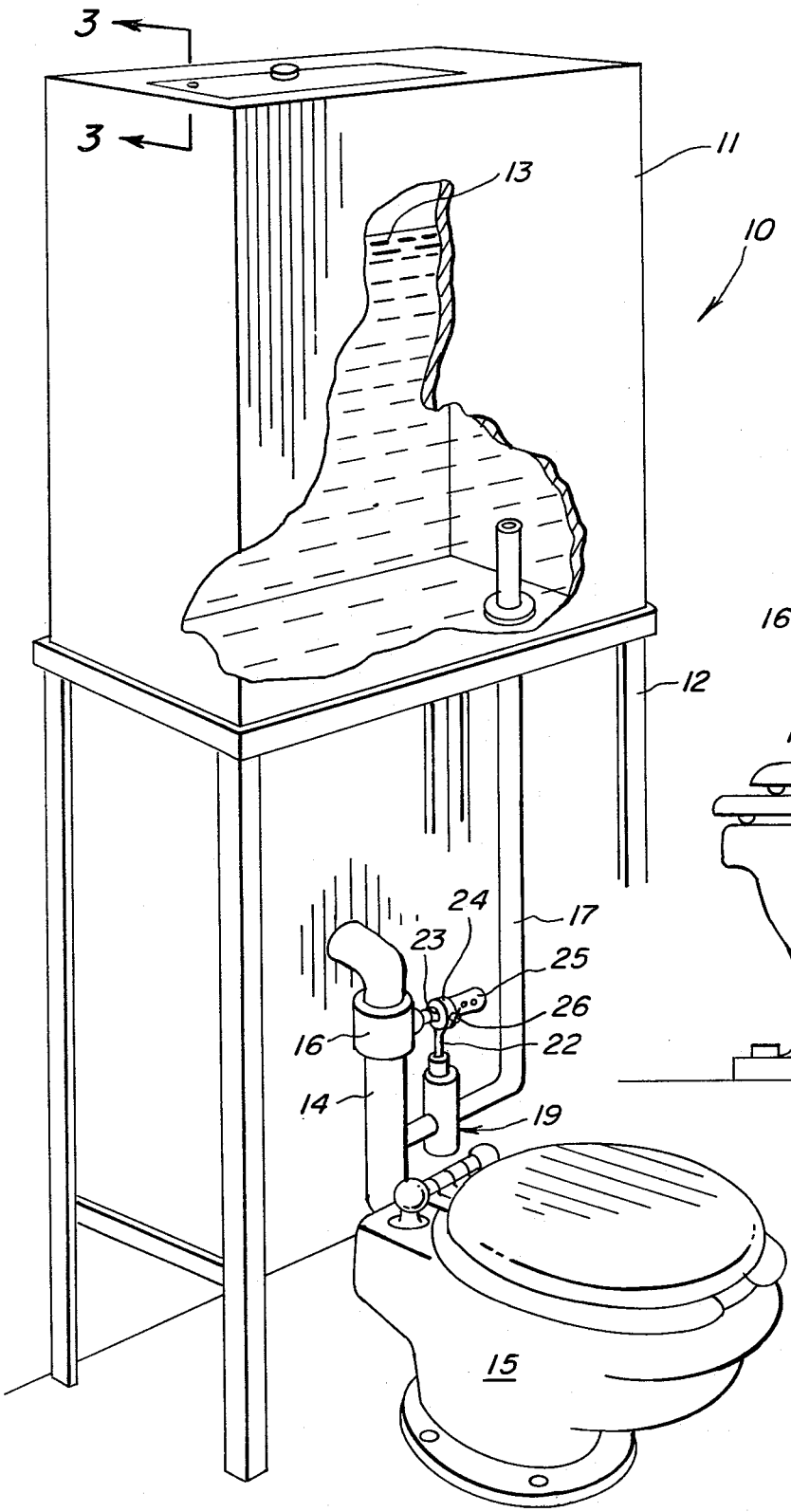
FIG. 1 is a front perspective view of the invention.

Referring now to the drawing in greater detail, the reference numeral 10 represent a high pressure toilet water feeder conservation tank assembly according to the present invention, wherein the tank 11 is placed on a stand 12, so that conserved water 13 in the tank is located high above the fresh water supply pipe 14 of a toilet 15 that is normally flushed by a conventional high pressure valve 16 located along the pipe 14.

Figure 2:
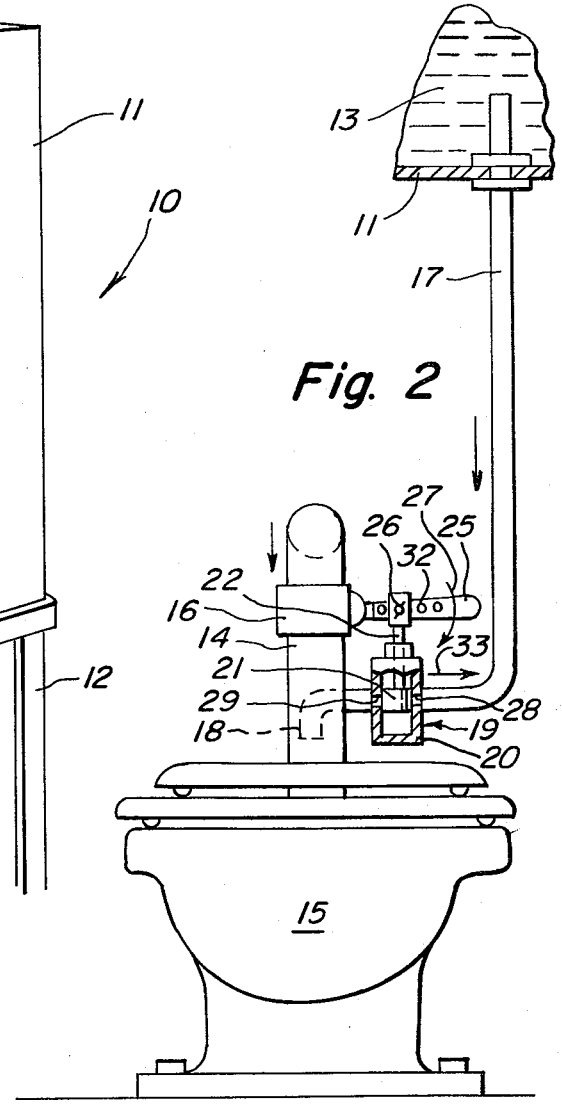
FIG. 2 is a front elevational view thereof.

In the present invention, a drain pipe 17 from a bottom of the tank 11 is connected at its lower end 18 to the fresh water supply pipe 14; the pipe 17 being intercepted by a valve 19 that is automatically operated by the high pressure valve 16. As shown in FIG. 2, the end 18 is extended into the center of the pipe 14.

The valve 19 comprises a cylinder 20 containing a slidable piston 21 inside of a cylinder chamber. A piston rod 22 protruding out of one end of the cylinder, has an enlarged, transverse hole 23 through an enlarged head 24 on the end of the piston rod, so as to fit on a pivotable handle 25 of the high pressure valve 16. A wing screw 26 secures the piston rod pivotally free to the handle 25.

In operative use, the toilet is flushed by pivoting the handle 25 as shown by arrow 27, thus causing fresh water to be flushed into the toilet. At the same time, the pivoting of the handle 25 causes the piston 21 to be slided out of the way between the holes 28 and 29 on opposite sides of the cylinder, so as to allow the conserved water to run through the valve 19 and into the pipe 14. When the handle 25 is released to its free position, the valve 19 thus shuts off automatically therewith.

Proportional changes of fresh and conserved water may be achieved by regulating the operating parameters of valve 19 as required. Specifically the proportion of tank water used per flush may be increased by mounting valve unit 19 further away, in the direction as indicated by arrow 33, from pipe 14 and utilizing a hole 32 on handle 25 which is closer to its end extremity.

Figure 3:
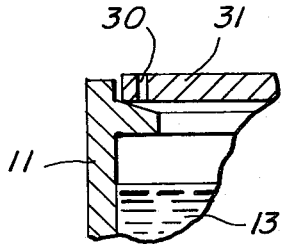
FIG. 3 is an enlarged cross sectional view on line 3—3 of FIG. 1.

As shown in FIG. 3, an air vent hole 30 in the tank cover 31 allows air replacement into the tank as the conserved water is drained outward therefrom.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A high pressure toilet water feeder conservation tank assembly, comprising in combination, a tank for storing used water, a drain pipe from said tank being connected at its lower end to a fresh water supply pipe of a toilet, a high pressure valve connected along said fresh water supply pipe, a handle pivotally extending from said high pressure valve for flushing operation thereof, a control valve along said drain pipe comprising a cylinder connected across said drain pipe and a piston slidable in said cylinder for regulating the flow of used water through said cylinder, a connecting arm between said piston and handle, and means for adjustably coupling said connecting arm along said handle, whereby the proportion of tank water used per flush is increased by coupling the connecting arm closer to the free end of the handle and decreased by coupling the connecting arm closer to the pivoted end of the handle.

* * * * *